US007108388B2

(12) United States Patent
Li

(10) Patent No.: US 7,108,388 B2
(45) **Date of Patent: *Sep. 19, 2006**

(54) LIGHTING ARRANGEMENT FOR OUTDOORS UMBRELLA

(76) Inventor: Wanda Yiing Li, 121 E. Alton, Santa Ana, CA (US) 92707

( * ) Notice: Subject to any disclaimer, the term of this patent is extended or adjusted under 35 U.S.C. 154(b) by 0 days.

This patent is subject to a terminal disclaimer.

(21) Appl. No.: 10/957,056

(22) Filed: Oct. 1, 2004

(65) Prior Publication Data

US 2005/0041425 A1 Feb. 24, 2005

Related U.S. Application Data

(62) Division of application No. 10/621,215, filed on Jul. 17, 2003, now Pat. No. 6,966,667.

(51) Int. Cl.
*A45B 3/02* (2006.01)

(52) U.S. Cl. ..... 362/102; 362/234; 135/910

(58) Field of Classification Search ..... 362/102, 362/249, 252, 234, 183; 135/910, 16, 31
See application file for complete search history.

(56) References Cited

U.S. PATENT DOCUMENTS 5,611,614 A * 3/1997 Morgan ..... 362/102
6,598,990 B1 * 7/2003 Li ..... 362/102
6,612,713 B1 * 9/2003 Kuelbs ..... 362/102
6,666,224 B1 * 12/2003 Lee ..... 135/16

* cited by examiner

*Primary Examiner*—Thomas M. Sember
(74) *Attorney, Agent, or Firm*—Raymond Y. Chan; David & Raymond Patent Group

(57) ABSTRACT

An outdoors umbrella includes a supporting frame and a lighting arrangement. The supporting frame includes a supporting stem and a parasol frame, which is supported by the supporting stem, comprising a plurality of elongated awning ribs radially extended in a pivotally movable manner and a shading awning substantially supported by the awning ribs to define a shadowing area thereunder. The lighting arrangement includes a plurality of illumination holders provided along the awning ribs respectively, a power supply system mounted on the supporting frame and a chain illuminating system, which is electrically connected to the power supply system, comprising a plurality of chain lighting units alignedly held by the illumination holders along the awning ribs for illuminating the shadowing area.

8 Claims, 7 Drawing Sheets

LIGHTING ARRANGEMENT FOR OUTDOORS UMBRELLA

CROSS REFERENCE OF RELATED APPLICATION

This is a Divisional application that claims the benefit of priority under 35 U.S.C.§119 to a non-provisional application, application Ser. No. 10/621,215, filed Jul. 17, 2003 now U.S. Pat. No. 6,966,667.

BACKGROUND OF THE PRESENT INVENTION

1. Field of Invention

The present invention relates to an umbrella, and more particularly to an outdoors umbrella comprising a lighting arrangement which is mounted on awning ribs to form an integral structure for mainly providing illuminating under the outdoors umbrella.

2. Description of Related Arts

Nowadays, outdoors umbrellas are widely used for a wide variety of outdoors activities, such as camping, outdoors cooking like barbecue, and large-scale recreational functions such as money-raising Fairs. Moreover, they may even be used in some occupations in which their staff is required long exposure in outdoors environment. Car-parking assistances outside restaurants can be an example of this kind.

While the traditional use of outdoors umbrellas are for shading, problem arise when the outdoor activities continue at night, or possibly in a cloudy environment, in which the primary function of outdoors umbrellas fades, for there is nothing to shade. On the other hand, in such environment, the activities may be forced to stop unless there is illumination provided thereto. In outdoors environment, providing adequate illumination for a specified activity can be troublesome, inconvenient and frustrating. One may put portable lamps or lighting devices which are capable of standing on the ground near the outdoor umbrella. Or one may suspendedly hang such lighting devices on the outdoor umbrella—a method by which the users of the outdoors umbrella risk dropping down of the lighting devices easily.

Lighting arrangements have been developed which are to be mounted onto the outdoors umbrellas for providing illumination to the area thereunder—a method which is generally better than utilizing portable lamps. Yet there are still some common drawbacks or disadvantages for such conventional outdoors umbrellas. First, the lighting system may alter the original operation of the outdoors umbrella. Conventional lighting systems, such as a series of light bulbs or LEDs, are usually mounted on one of the frames of the outdoors umbrella in such a manner that they are in some sense 'protruded' from their frames to prevent the umbrella from being completely folded. Furthermore, in the course of transportation, the lighting devices of the outdoors umbrella may collide themselves or with the umbrella's frames. They may be easily destroyed without external causes.

Accordingly, in order to completely fold up the outdoors umbrella, say, for convenient storage, easy transport, or even just to avoid destroying the lighting system, the user may need to detach the lighting system from the outdoors umbrella and store them separately. When he/she wants to use it again, he/she doesn't have any choice but to reassemble the whole thing. Depending on the size of the umbrella and the complexity of the lighting system, the process can be very frustrating and time-consuming.

Last, problems arise as to the power source of the lighting system. It is conceivable that it may not be possible for the user to find an utilizable power source to light up the system. It should be remember, in outdoor environment, such as a campground, electricity may be difficult, if not impossible, to acquire.

SUMMARY OF THE PRESENT INVENTION

A main object of the present invention is to provide an outdoors umbrella incorporated with a lighting arrangement for mainly providing illumination to an illuminating zone under the umbrella.

Another object of the present invention is to provide an outdoors umbrella incorporated with a lighting arrangement wherein the presence of which does not alter the original structure and operation of the umbrella. In other words, the lighting arrangement is made to be compatible with most of the conventional outdoors umbrellas.

Another object of the present invention is to provide an outdoors umbrella comprising a lighting arrangement which is incorporated with supporting frames of the umbrella in such a manner that normal operation and transportation of the umbrella will not cause the lighting system subject to high risk of being damaged by the umbrella itself. In other words, the lighting arrangement needs not to be stored or transported separately with the umbrella in fear of potential damaging of the lighting system in the course of transportation or storing.

Another object of the present invention is to provide an outdoors umbrella incorporated with a lighting arrangement which does not involve complicated mechanical and electrical equipments so as to minimize the manufacturing and related of the present invention.

Accordingly, in order to accomplish the above objects, the present invention provides an outdoors umbrella, comprising:

a supporting frame which comprises:

a supporting stem; and a parasol frame, which is supported by the supporting stem, comprising a plurality of elongated awning ribs radially extended in a pivotally movable manner and a shading awning substantially supported by the awning ribs to define a shadowing area thereunder; and a lighting arrangement comprising a plurality of illumination holders provided along the awning ribs respectively, a power supply system mounted on the supporting frame and a chain illuminating system, which is electrically connected to the power supply system, comprising a plurality of chain lighting units alignedly held by the illumination holders along the awning ribs for illuminating the shadowing area.

These and other objectives, features, and advantages of the present invention will become apparent from the following detailed description, the accompanying drawings, and the appended claims.

DETAILED DESCRIPTION OF THE PREFERRED EMBODIMENT

Figure 1:
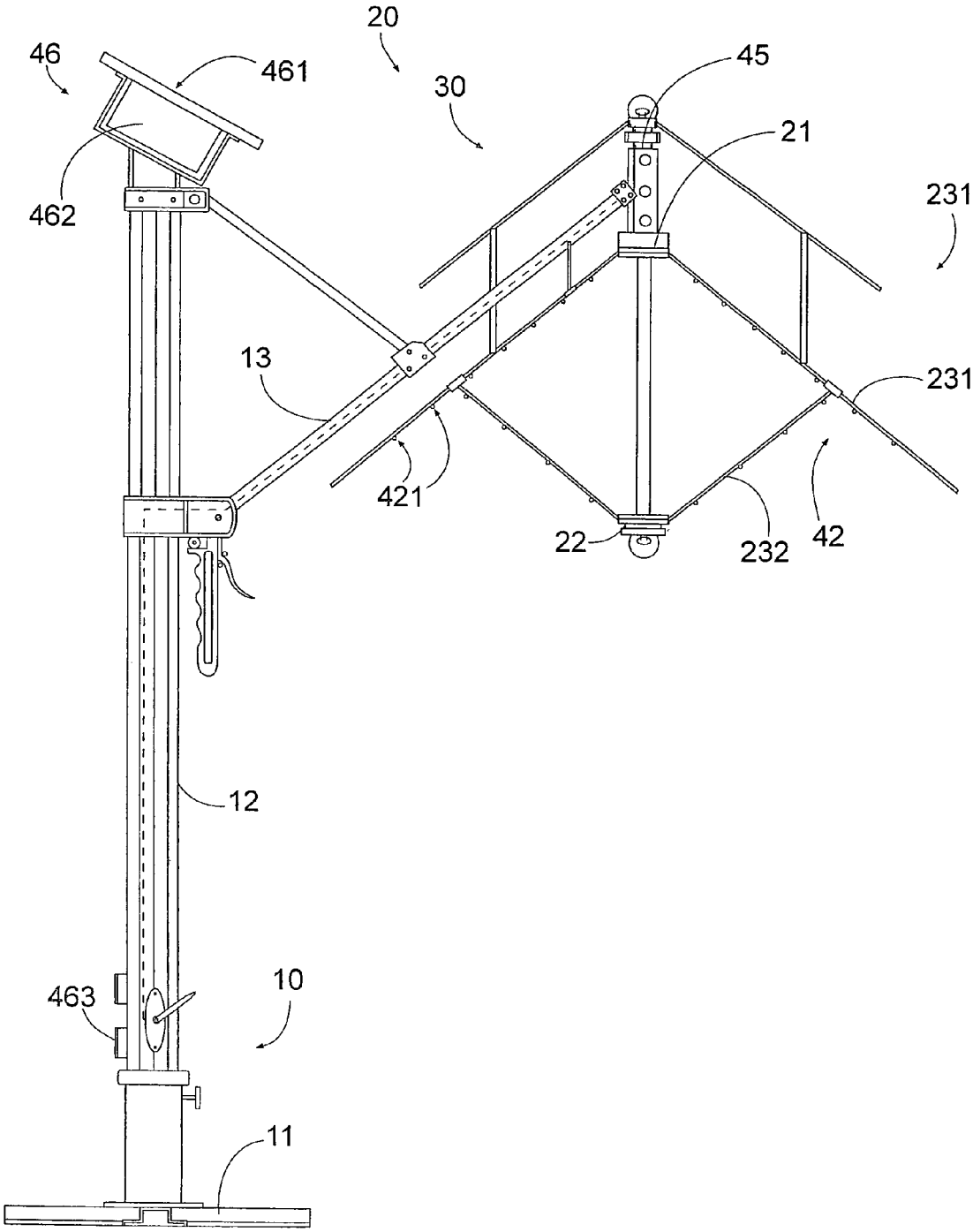
FIG. 1 is a schematic diagram of an outdoors umbrella with a lighting arrangement according to a preferred embodiment of the present invention.

According to FIG. 1 of the drawings, an outdoors umbrella 1 according to a preferred embodiment of the present invention is illustrated. According to the preferred embodiment, the outdoors umbrella 1 comprises a supporting frame 10, a shading frame 20, a fabric shading awning 30, and a lighting arrangement 40.

The supporting frame 10 comprises a base 11, and a supporting stem 12 upwardly and vertically extended therefrom for supporting the shading frame 20, the shading awning 30 and the lighting arrangement 40. The supporting frame 10 further comprises a linking arm 13 transversely and pivotally extended from the supporting stem 12 to movably connect the shading frame 20 so as to support shading frame 20 in a suspended manner.

The shading frame 20 comprises a top housing 21, a bottom housing 22 positioned under the top housing 21, and a parasol frame 23 foldably connected between the top housing 21 and the bottom housing 22, wherein the fabric shading awning 30 is substantially mounted and supported on the parasol frame 23 to define a shadowing area thereunder.

The parasol frame 23 comprises a plurality of elongated awning ribs 231 downwardly and radially extended from the top housing 21 in a pivotally movable manner, and a plurality of connecting bars 232 upwardly and radially extended from the bottom housing 22 to rotatably connect with the elongated awning ribs 231 respectively. According to the preferred embodiment of the present invention, the supporting arm 13 extended from the supporting stem 12 is pivotally connected with one of the elongated awning ribs 231 so as to suspendedly support the shading frame 20 in a foldable manner. In addition, the awning ribs 231 are capable of folding between a folded position and an unfolded position, wherein at the folded position, the awning ribs 231 are pivotally and downwardly folded to minimize the shadowing area, and at the unfolded position, the awning ribs 231 are pivotally and upwardly extended to enlarge the shadowing area.

Figure 2:
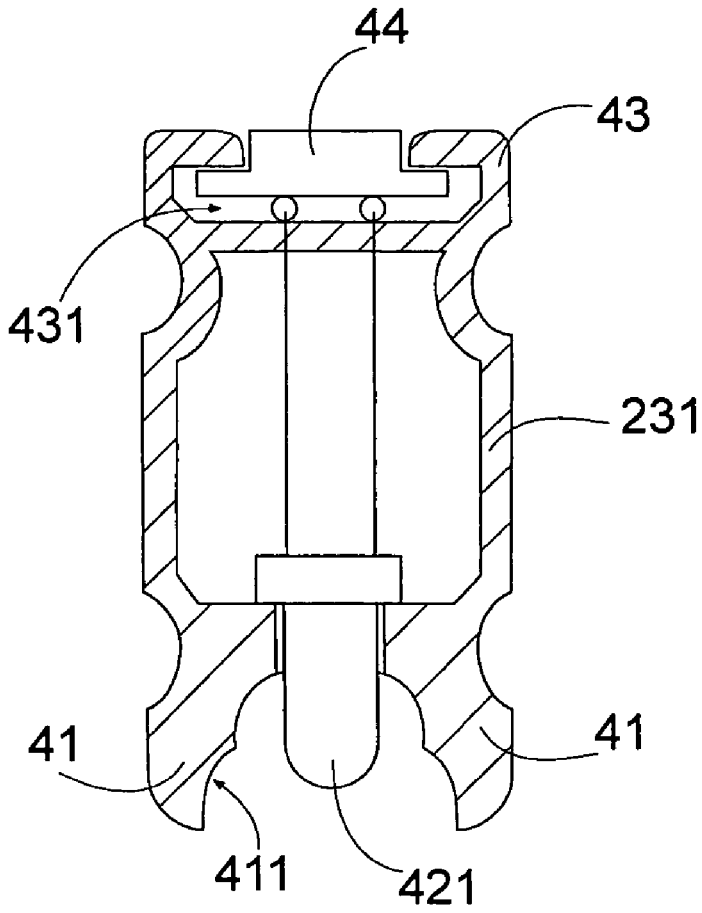
FIG. 2 is a side view of an elongated awning rib incorporated with the lighting arrangement according to the above preferred embodiment of the present invention.

Referring to FIG. 2 of the drawings, the lighting arrangement 40 has a plurality of illumination holders 411 provided along the awning ribs 231 respectively. Accordingly, each of the illumination holders 411 is embodied as an elongated receiving groove 411 formed along a bottom side of the respective awning rib 231. The lighting arrangement 40 further comprises two retaining walls 41 downwardly and integrally extended along the bottom side of each of the awning ribs 231 wherein the receiving groove 411 is defined between the respective two retaining walls 41 and the bottom side along the respective awning rib 231. Accordingly, an inner side of each of the retaining walls 41 is concavely curved so that it is capable of intensely reflecting any illumination generated within the receiving groove 411 to an outside thereof.

The lighting arrangement 40 further comprises a chain illuminating system 42 comprising a plurality of chain lighting units 421 alignedly received in the receiving grooves 411 respectively wherein the illumination generated by the chain lighting units 421 are intensely and substantially reflected out of the receiving grooves 411 by the retaining walls 41 so as to illuminate the shadowing area of the shading frame 20 of the outdoors umbrella 1. Moreover, since the chain lighting units 421 are substantially received in the receiving grooves 411 respectively, they are substantially protected from any potential damage resulting from any mechanical operation of the outdoors umbrella 1 of the present invention, such as folding or unfolding. In other words, the lighting arrangement 40 of the present invention substantially overcome the conventional disadvantage of potentially damaging the chain lighting units 421 by the umbrella's own mechanical operations, such as folding and unfolding.

The lighting arrangement 40 further comprises two electric boundaries 43 upwardly and integrally extended along an upper side of each of the awning ribs 231 to form an electric channels 431 between the two electric boundaries 43, as shown in FIG. 2 of the drawings. According to the preferred embodiment, each of the awning ribs 231 is a hollow body wherein the receiving groove 411 on each awning rib 231 is capable of communicating with the respective electric channels 431 through the interior of the awning rib 231.

Figure 3:
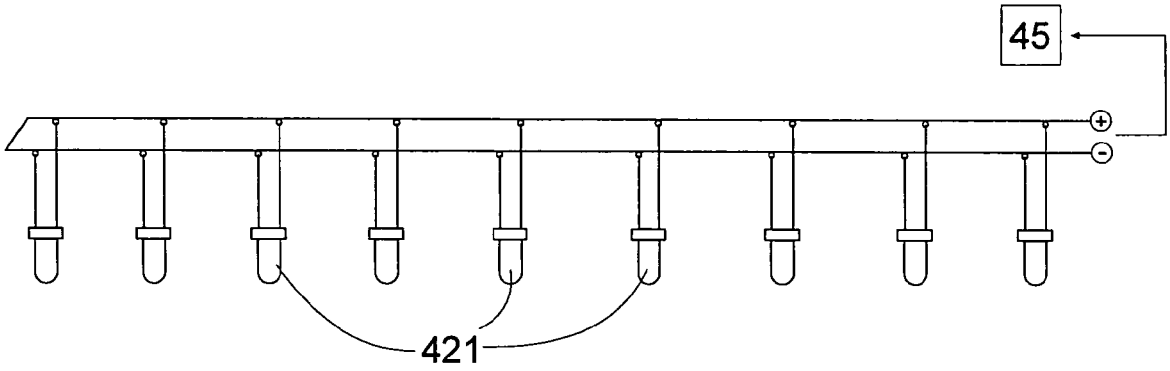
FIG. 3 is a schematic diagram of the connection of the chain lighting units according to the above preferred embodiment of the present invention.

Referring to FIGS. 2 and 3 of the drawings, the chain lighting units 421 in each of the awning ribs 421 are electrically connected in series through the respective awning ribs 231 by an electric cord which is received in the respective electric channel 431, wherein the electrical cord has two terminals, namely positive and negative, which are extended to the top housing 21 and then electrically connected to a power source for the provision of energy to light up the chain lighting units 421. In order to further protect the lighting arrangement 40 from potential physical damage by external objects, the lighting arrangement 40 further comprises a plurality of light holders 44 slidably inserted into the electric channels 431 respectively. The chain lighting units 421 are spacedly mounted at the respective light holder 44 such that light holder 44 is adapted to hold the chain lighting units 421 in position along the awning ribs 231 and to enclose the electric channels 431 to protect the chain lighting units 421 within the receiving grooves 411 respectively. According to the preferred embodiment, the chain lighting units 421 could be embodied as regular LEDs which are capable of illuminating light of differing colors and brightness.

The lighting arrangement 40 further comprises an IC board 45 mounted in the top housing 21 wherein the terminals of electric cord mounted on each of the awning ribs 231 are electrically connected to the IC board 45 which is further electrically connected to a power source via electrical wires.

According to the preferred embodiment, the lighting arrangement 40 further comprises a power supply system 46 attached on the supporting frame 10 of the outdoors umbrella 1 and electrically connected to the IC board 45 for providing electricity to the chain illuminating system 42. The power supply system 45 can be embodied as a rechargeable battery delivering direct current (DC) and with a switch provided thereon so that no external AC power source is required. Of course, the power supply system can also be embodied as a transformer electrically connected to an external AC power supply for providing electrical energy of predetermined voltage and current to the chain illuminating system 42.

Alternatively, as shown in FIG. 1 of the drawings, the power supply system 46 can be embodied as comprising a solar energy collector 461 attached on the top housing 21, a storage capacitor 462 attached on top of the supporting stem 12 and electrically connected with the solar energy collector 461, and a lighting switch 463 provided on the supporting frame 10 and electrically connected with the storage capacitor 462. The solar energy collector 461 is adapted for collecting solar energy and transforming it into electrical energy as a power source which is ultimately stored by the storage capacitor 462. The storage capacitor 462 is electrically connected with the chain illuminating system 42 and adapted for providing it electrical energy which is collected by the solar energy collector 461 upon switched on by the lighting switch 463.

It is worth mentioning that some trivial alternatives to the above-mentioned power supply system 46 could also be easily anticipated, and therefore should also be protected. For example, the positions on which the solar energy collector 461 and the storage capacitor 462 are mounted can be interchanged. Or the storage capacitor 462 can be mounted under the solar energy collector 461 on top of the top housing 21.

From the forgoing description, it can be shown that the outdoors umbrella 1 of the present invention comprises the chain lighting units 421 which are embedded in the awning ribs 231 respectively to form an integral awning body. As a result, users of the present invention can enjoy illumination without fear of any storage or operational problems of the outdoors umbrella 1.

Figure 4:
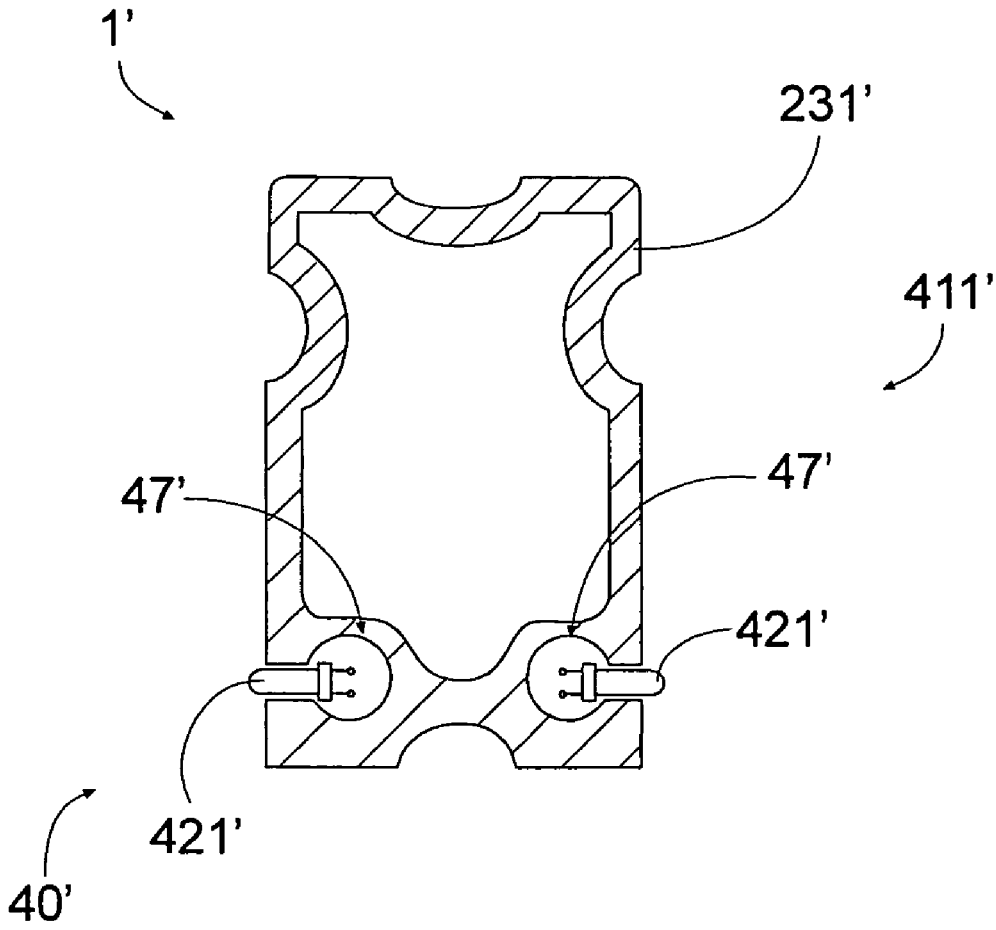
FIG. 4 is a first alternative mode of the lighting arrangement according to the above preferred embodiment of the present invention.

Referring to FIG. 4 of the drawings, a first alternative mode of the lighting arrangement 40' according to the above preferred embodiment of the outdoors umbrella 1' is illustrated. According to the first alternative mode, each of the illumination holders 411' has two lighting slots 47' indently formed on two sidewalls of each of the awning ribs 231' respectively wherein the chain lighting units 421' of the chain illuminating system 42' are alignedly received in the lighting slots 47' respectively. Note that, as in the case of the above-mentioned preferred embodiment, the chain lighting units 421' in each of the awning ribs 421' are also electrically connected in series through the respective awning ribs 231' by the electric cord which is received in the respective lighting slots 47', wherein the electrical cord has two terminals, namely positive and negative, which are extended to the top housing 21 and then electrically connected to a power source for the provision of energy to light up the chain lighting units 421'.

Figure 5:
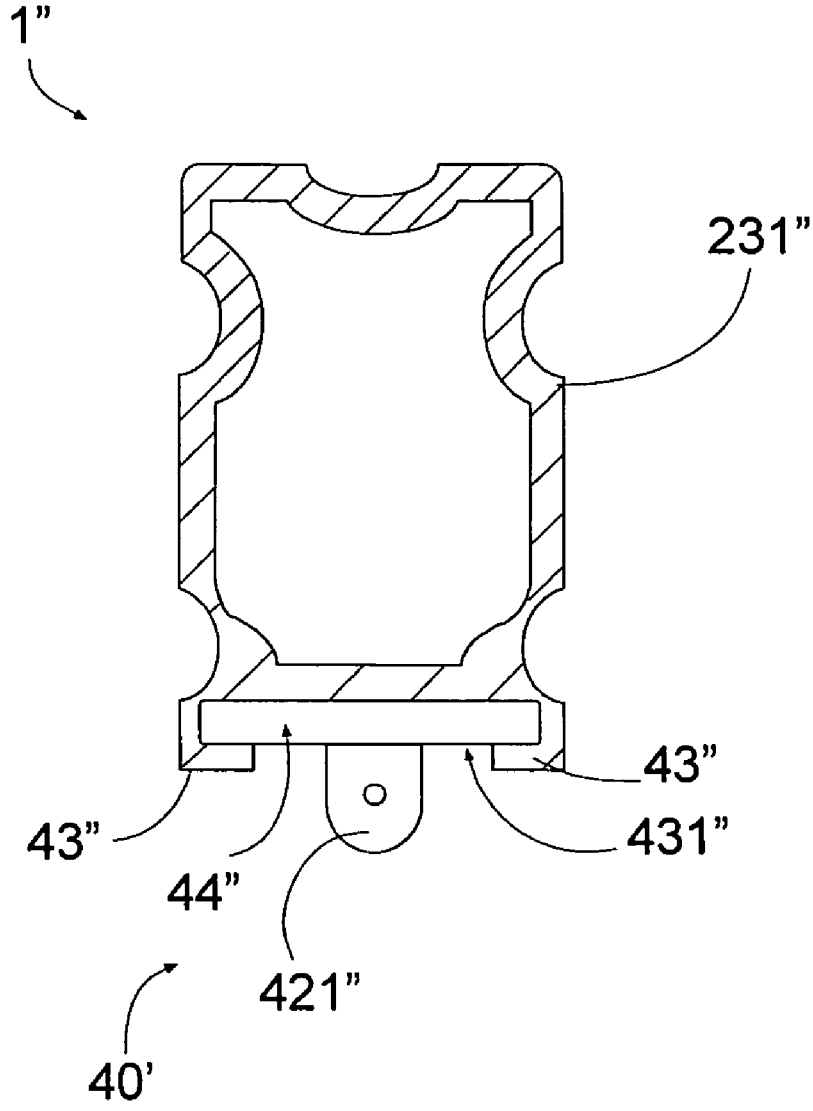
FIG. 5 is a second alternative mode of the lighting arrangement according to the above preferred embodiment of the present invention.

Referring to FIG. 5 of the drawings, a second alternative mode of the outdoors umbrella 1" is illustrated, which concerns with a second alternative mode of the lighting arrangement 40". According to the second alternative mode, the retaining wall 41 and the receiving groove 411 in the preferred embodiment cease to exist. Furthermore, the L-shaped electric boundaries 43" and the electric channel 431" are provided at a bottom side of each of the awning ribs 231" as the illumination holders 411" wherein each of the light holders 44" is embodied as an elongated protective strip which is arranged to be slidably mounted in the respective electric channel 431". The electric cord connecting the illuminating units 421" is arranged to be embedded into the elongated protective strip so that it will not in direct contact with external objects, thus reducing the possibility of being damaged thereby. As in the case mentioned above, the electric cord is then extended to the power supply system 46 for acquiring transmitting electricity to the chain lighting units 421".

Figure 6:
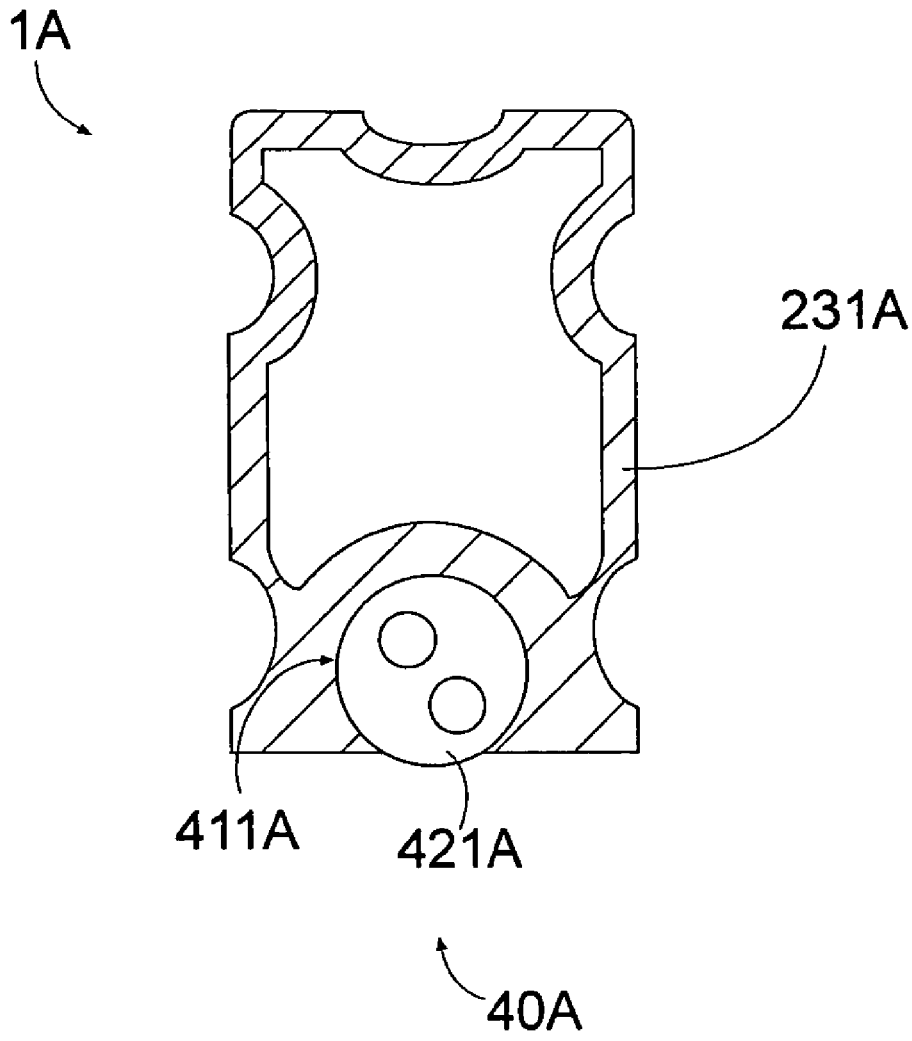
FIG. 6 is a third alternative mode of the lighting arrangement according to the above preferred embodiment of the present invention.

Referring to FIG. 6 of the drawings, a third alternative mode of the outdoors umbrella 1A according to the preferred embodiment of the present invention is illustrated. The third alternative mode of the outdoors umbrella 1A mainly concerns with third alternative mode of the lighting arrangement 40A. According to the third alternative mode, the electric boundaries 43 and the electric channel 431 cease to exist, and that each of the chain lighting units 421A is embodied as a rope light received in the receiving groove 411A of the respective awning rib 231A. As a result, the illuminating units 421A as well as the electric cord are substantially protected from direct physical contact with external objects so that the possibility of undesirable damage can be minimized.

Figure 7:
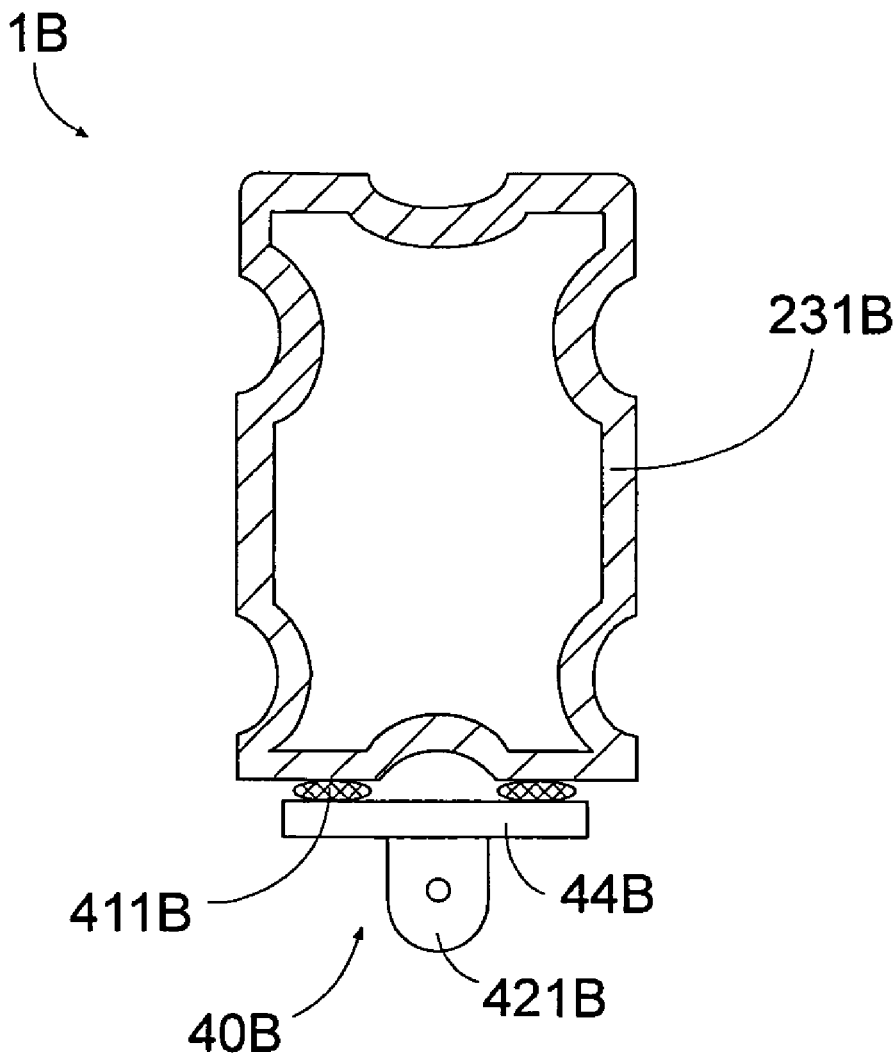
FIG. 7 is a fourth alternative mode of the lighting arrangement according to the above preferred embodiment of the present invention.

Referring to FIG. 7 of the drawings, a fourth alternative mode of the lighting arrangement 40B according to the above preferred embodiment is illustrated. According to the fourth alternative mode, the retaining wall 41, the receiving groove 411, the electric boundaries 43 and the electric channel 431 as shown in the preferred embodiment cease to exist. Each of the light holders 44B is embodied as an elongated protective strip wherein the chain lighting units 421B are spacedly mounted on the light holders 44B. Each of the illumination holders 411B comprises an adhesive element provided on the bottom side of the respective awning rib 2311B to attach on the light holder 44B so as to support the chain lighting units 421B along the awning rib 231B.

Accordingly, the adhesive element of the illumination holder 411B can be any adhesive agent, such as a double-sided tape. In addition, the electric cord connecting the chain lighting units 421B is arranged to be embedded into the elongated protective strip of the respective light holder 44B so that it will not in direct contact with external objects, thus reducing the possibility of being damaged thereby. The electric cord is then extended to the power supply system 46 for acquiring transmitting electricity to the chain lighting units 421B.

It is worth to mention that the original structure of the outdoor umbrella does not required to be altered when the outdoor umbrella incorporates with the lighting arrangement 40B so as to minimize the manufacturing cost of the outdoor umbrella having the awning ribs 231B.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An outdoors umbrella, comprising:

a supporting frame which comprises:

a supporting stem; and a parasol frame, which is supported by said supporting stem, comprising a plurality of elongated awning ribs radially extended in a pivotally movable manner and a shading awning substantially supported by said awning ribs to define a shadowing area thereunder; and a lighting arrangement comprising a power supply system and an illuminating system electrically connected to said power supply system, wherein said illuminating system comprises lighting units supported along said awning ribs for illuminating said shadowing area and electric cords electrically connecting said lighting units and extending in said awning ribs, wherein said lighting arrangement further has a plurality of illumination holders provided along said awning ribs to hold said lighting units in position along said awning ribs respectively and a plurality of electric channels along said awning ribs respectively, wherein said electric cords are received and extended along said electric channels respectively, wherein each of said illumination holders has an elongated receiving groove provided on a bottom side of said respective awning rib, wherein said lighting units are received in said receiving grooves respectively, wherein said lighting arrangement further comprises a plurality pairs of electric boundaries each upwardly extended along upper sides of said awning ribs to define said electric channels therebetween respectively, wherein said electric channel communicates with said receiving groove through an interior of each said awning rib.

2. The outdoors umbrella, as recited in claim 1, wherein said power supply system comprises a solar energy collector, which is attached on top of said supporting stem and electrically connected to said illuminating system, is arranged for collecting solar energy as a power source to said illuminating system.

3. An outdoors umbrella, comprising:

a supporting frame which comprises:

a supporting stem; and a parasol frame, which is supported by said supporting stem, comprising a plurality of elongated awning ribs radially extended in a pivotally movable manner and a shading awning substantially supported by said awning ribs to define a shadowing area thereunder; and a lighting arrangement comprising a power supply system and an illuminating system electrically connected to said power supply system, wherein said illuminating system comprises lighting units supported along said awning ribs for illuminating said shadowing area and electric cords electrically connecting said lighting units and extending in said awning ribs, wherein said lighting arrangement further has a plurality of illumination holders provided along said awning ribs to hold said lighting units in position along said awning ribs respectively and a plurality of electric channels along said awning ribs respectively, wherein said electric cords are received and extended along said electric channels respectively, wherein each of said illumination holder has two lighting slots formed on two sidewalls of each of said awning ribs respectively, wherein said lighting units are alignedly received in said lighting slots respectively.

4. The outdoors umbrella, as recited in claim 3, wherein said two lighting slots also function as said electric channel of each of said awning ribs, wherein said electric cords are received and extended in said lighting slots respectively.

5. The outdoors umbrella, as recited in claim 4, wherein said power supply system comprises a solar energy collector which is provided on top of said outdoors umbrella and electrically connected with said illuminating system, is arranged for collecting solar energy as a power source to said illuminating system.

6. An outdoors umbrella, comprising:

a supporting frame which comprises:

a supporting stem; and a parasol frame, which is supported by said supporting stem, comprising a plurality of elongated awning ribs radially extended in a pivotally movable manner and a shading awning substantially supported by said awning ribs to define a shadowing area thereunder; and a lighting arrangement comprising a power supply system and an illuminating system electrically connected to said power supply system, wherein said illuminating system comprises lighting units supported along said awning ribs for illuminating said shadowing area and electric cords electrically connecting said lighting units and extending in said awning ribs, wherein said lighting arrangement further has a plurality of illumination holders provided along said awning ribs to hold said lighting units in position along said awning ribs respectively and a plurality of electric channels along said awning ribs respectively, wherein said electric cords are received and extended along said electric channels respectively, wherein each of said awing ribs comprises a pair of L-shaped electric boundaries provided on a bottom side thereof to define said illumination holder and said electric channel therebetween, wherein said illuminating system comprises a plurality of elongated protective strips and said electric cords connecting said illuminating units are arranged to be embedded into said elongated protective strips, wherein said elongated protective strips are slidably mounted in said electric channels respectively while said illuminating units are supported along said illumination holders.

7. An outdoors umbrella, comprising:

a supporting frame which comprises:

a supporting stem; and a parasol frame, which is supported by said supporting stem, comprising a plurality of elongated awning ribs radially extended in a pivotally movable manner and a shading awning substantially supported by said awning ribs to define a shadowing area thereunder; and a lighting arrangement comprising a power supply system and an illuminating system electrically connected to said power supply system, wherein said illuminating system comprises lighting units supported along said awning ribs for illuminating said shadowing area and electric cords electrically connecting said lighting units and extending in said awning ribs, wherein said lighting arrangement further has a plurality of illumination holders provided along said awning ribs to hold said lighting units in position along said awning ribs respectively and a plurality of electric channels along said awning ribs respectively, wherein said electric cords are received and extended along said electric channels respectively, wherein said illuminating system comprises a plurality of elongated protective strips and said electric cords connecting said illuminating units are arranged to be embedded into said elongated protective strips, wherein each of said illumination holders comprises an adhesive element provided on a bottom side of said respective awning rib, wherein said elongated protective strips are attached to said adhesive elements respectively so as to support said illuminating units along said awning ribs.

8. The outdoors umbrella, as recited in claim 7, wherein said power supply system comprises a solar energy collector which is provided on top of said outdoors umbrella and electrically connected with said illuminating system, is arranged for collecting solar energy as a power source to said illuminating system.

* * * * *